US007282846B2

(12) United States Patent
Chen

(10) Patent No.: US 7,282,846 B2
(45) Date of Patent: Oct. 16, 2007

(54) CHRISTMAS BULB STRUCTURE

(76) Inventor: Chin Lung Chen, No. 80, Lane 131, Haipu Rd., Hsinchu (TW)

( * ) Notice: Subject to any disclaimer, the term of this patent is extended or adjusted under 35 U.S.C. 154(b) by 121 days.

(21) Appl. No.: 11/196,308

(22) Filed: Aug. 4, 2005

(65) Prior Publication Data

US 2007/0029913 A1 Feb. 8, 2007

(51) Int. Cl.
*H01K 1/00* (2006.01)

(52) U.S. Cl. ..... 313/316; 313/315

(58) Field of Classification Search ..... 313/315
See application file for complete search history.

(56) References Cited

U.S. PATENT DOCUMENTS 2,627,590 A * 2/1953 Selfrid ..... 315/72
6,107,746 A * 8/2000 Chen ..... 315/185 R
6,642,660 B1 * 11/2003 Shieh ..... 315/75

* cited by examiner

*Primary Examiner*—David Bruce
*Assistant Examiner*—Conrad R Blease
(74) *Attorney, Agent, or Firm*—Rosenberg, Klein & Lee

(57) ABSTRACT

The present invention discloses an improved Christmas bulb structure, which comprises: a bulb shell; two conductive wire, extending from the interior of the bulb shell to the exterior of the bulb shell; an insulator, separating those two conductive wires; an elastic platelet, installed between those two conductive wires; a tungsten filament, with its two ends separately connecting the elastic platelet and one of those two conductive wires; and a transverse conductive wire, installed inside the insulator and between those two conductive wires; when the Christmas bulb structure is electrically powered, the other conductive wire will contact the elastic platelet, and the tungsten filament will be lit on. The present invention is characterized in that the transverse conductive wire enables the Christmas bulb structure to possess two current paths; thereby, the present invention can obtain a diversified lighting effect, and the cost can be lowered.

4 Claims, 3 Drawing Sheets

CHRISTMAS BULB STRUCTURE

BACKGROUND OF THE INVENTION

1. Field of the Invention

The present invention relates to a Christmas bulb structure, particularly to an improved Christmas bulb structure.

2. Description of the Related Art

Christmas bulb structures are usually wound around a Christmas tree, or hang on walls or below eaves, and the flickering of Christmas bulb structures can create warm and happy ambiance for the festival.

There are two kinds of Christmas bulb structures. One of them is the primary bulb, and the other is the secondary bulb. The light string formed of secondary bulbs is constantly lit on or lit off, which lacks variety and brings about a dull sensation. Therefore, there is a kind of control box used for controlling the secondary bulbs to create a diversified lighting effect. However, the cost of the light string is raised because of the high price of the control box.

Referring to FIG. 1, the primary bulb has a bulb shell 2, and two conductive wires 4, including a first conductive wire 42 and a second conductive wire 44, extend from the interior of the bulb shell 2 to the exterior of the bulk shell 2; an insulator 6 separates those two conductive wires 4; an elastic platelet 8 disposed between those two conductive wire 4 is inserted into the insulator 6; both ends of a tungsten filament 10 separately connect the elastic platelet 8 and the first conductive wire 42; the second conductive wire 44 does not contact the elastic platelet 8 normally, but when the primary bulb is electrically powered, the elastic platelet 8 contacts the second conductive wire 44, and the current flows through the tungsten filament 10, and the tungsten filament 10 is lit on; once the elastic platelet 8 is heated to a given temperature, the elastic platelet 8 springs away from the second conductive wire 44, and the elastic platelet 8 no more contacts the second conductive wire 44, and thus, the light of the primary bulb ceases; as there is only one current path in the primary bulb, and as the light string is formed via connecting the primary bulb with the secondary bulbs in series, the in-series connected secondary bulbs also cease simultaneously. Consequently, the entire light string is lit on or lit off synchronically with the primary bulb, which presents a visual effect lacking variety.

Accordingly, the present invention proposes an improved Christmas bulb structure to overcome the abovementioned problem.

SUMMARY OF THE INVENTION

The primary objective of the present invention is to provide an improved Christmas bulb structure, wherein a second current path is formed via installing a transverse conductive wire between two conductive wires.

Another objective of the present invention is to provide an improved Christmas bulb structure in order to obtain a diversified lighting effect.

To achieve the abovementioned objectives, the present invention proposes an improved Christmas bulb structure, wherein two conductive wires extend from the interior of a bulb shell to the exterior of the bulb shell; an insulator is disposed between those two conductive wires in order to separate them; an elastic platelet is disposed between those two conductive wires; a tungsten filament connects with the elastic platelet and one of those two conductive wires; when the Christmas bulb structure is electrically powered, the other conductive wire contacts the elastic platelet, and the tungsten filament is lit on; a transverse conductive wire is installed inside the insulator and between those two conductive wires for conducting current. Thus, the Christmas bulb structure according to the present invention has two current paths.

To enable the objectives, technical contents, characteristics, and accomplishments of the present invention to be more easily understood, the embodiments of the present invention are to be described below in detail in cooperation with the attached drawings.

DETAILED DESCRIPTION OF THE INVENTION

The present invention obtains a diversified lighting effect via installing a transverse conductive wire between two conductive wires and near the bottom of the bulb shell.

Figure 1:
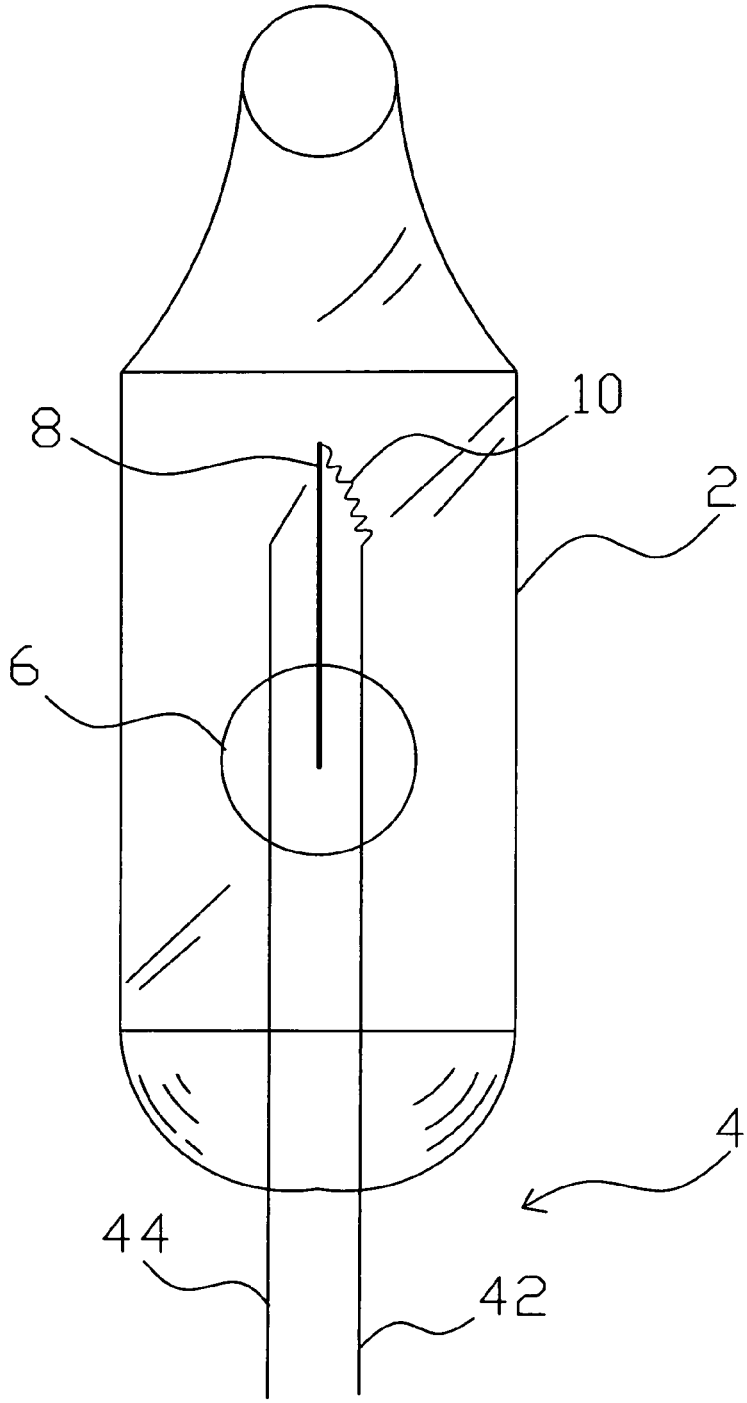
FIG. 1 (Prior art)
FIG. 1 is a schematic diagram showing a conventional Christmas bulb structure.
Figure 2:
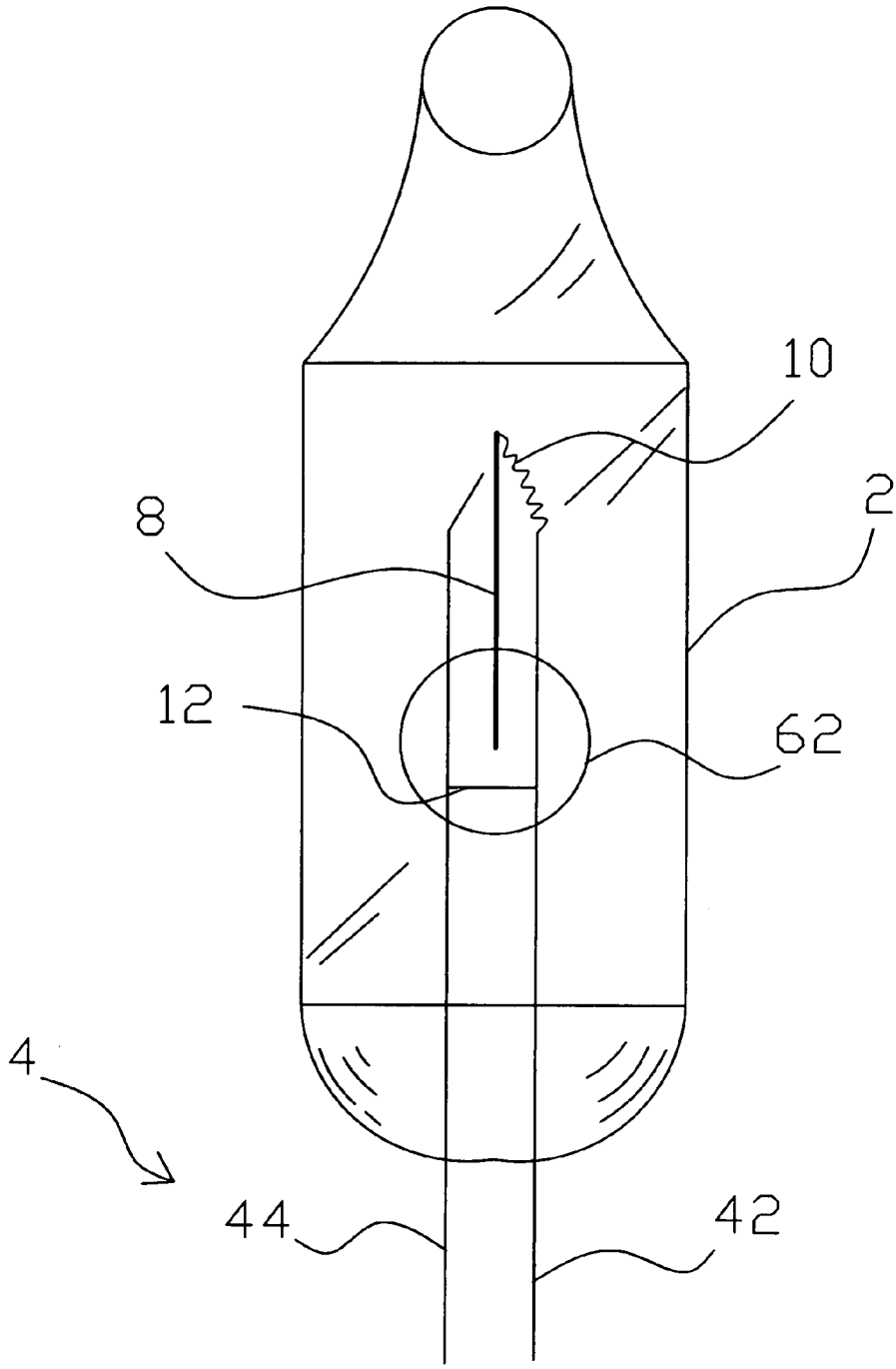
FIG. 2 is a schematic diagram showing the improved Christmas bulb structure according to the present invention.

As shown in FIG. 2, the Christmas bulb structure has a bulb shell 2; two conductive wires 4 extend from the interior of the bulb shell 2 to the exterior of the bulb shell 2; those two conductive wires 4 are respectively a first conductive wire 42 and a second conductive wire 44; those two conductive wires 4 are separated by an insulator 62; an elastic platelet 8 is disposed between those two conductive wires 4 and inserted into the insulator 62; the first conductive wire 42 is connected with the elastic platelet 8 via a tungsten filament 10, and the second conductive wire 44 does not contact the elastic platelet 8; a transverse conductive wire 12 is installed inside the insulator 62 and between those two conductive wires 4, and the transverse conductive wire 12 does not contact the elastic platelet 8; the transverse conductive wire 12 and those two conductive wires 4 are made of the same material—a magnesium-plated wire.

Figure 3:
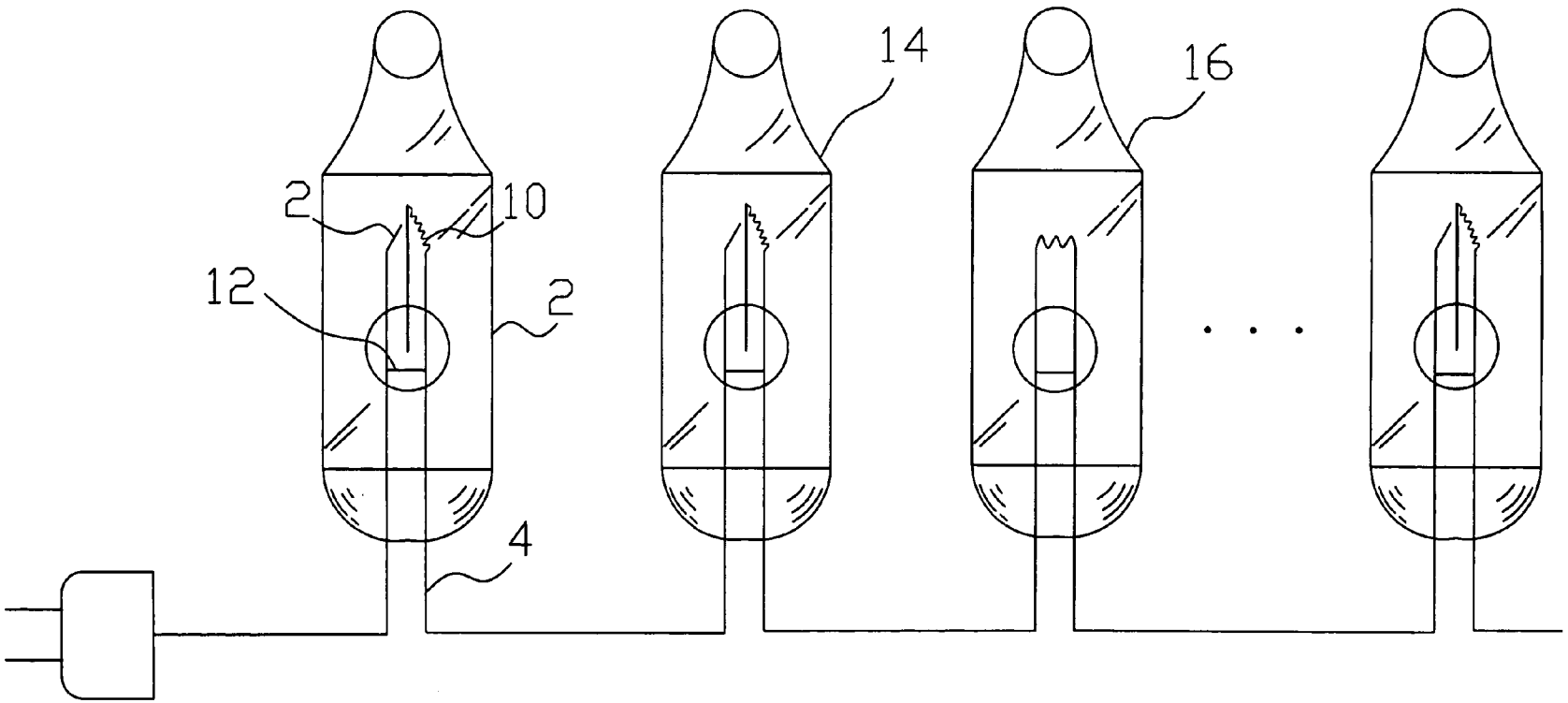
FIG. 3 is a schematic diagram showing one embodiment of the present invention.

Refer to FIG. 3 showing one embodiment of the present invention, which is formed via connecting the Christmas bulb structures in series. The elastic platelet 8 is installed between those two conductive wires 4, and the first conductive wire 42 is coupled to the elastic platelet 8 via the tungsten filament 10. Although the second conductive wire 44 does not contact the elastic platelet 8, it will contact the elastic platelet 8 when the bulb structure is electrically powered; thus, the current will flow from the second conductive wire 44 to the first conductive wire 42, and the tungsten filament 10 will be lit on. As the transverse conductive wire 12 is installed between those two conductive wires 4, current can also flow through the transverse conductive wire 12; thus, the Christmas bulb structure has two current paths.

When the tungsten filament 10 is lit on, and once it is heated to a given temperature, the elastic platelet 8 will spring away from the second conductive wire 44; thus, current cannot flow from the second conductive wire 44 to the first conductive wire 42 via the tungsten filament 10. However, current can still flow to the succeeding Christmas bulb structure via the transverse conductive wire 12. The lighting of the Christmas bulb structure will not be influenced by that the elastic platelet 8 spring away from the second conductive wire 44 when one primary bulb reaches a specific temperature. In the present invention, the transverse conductive wire 12 can continue to conduct the current to the succeeding Christmas bulb structure, which may be a primary bulb 14 or a secondary bulb 16. Thus, the succeeding Christmas bulb structure can keep on flickering or constantly lighting, and a diversified lighting effect is obtained.

In summary, the present invention can provide a diversified lighting effect without using the control box. In the present invention, a transverse conductive wire is installed between those two conductive wires to enable the Christmas bulb structure to possess two current paths in order to obtain a diversified lighting effect of the Christmas bulb structure. Thus, the Christmas bulb structure becomes more vivid and interesting, and the cost of the Christmas bulb structure is lowered.

Those embodiments described above are only to clarify the present invention to enable the persons skilled in the art to understand, make, and use the present invention but not intended to limit the scope of the present invention. Any equivalent modification or variation without departing from the spirit of the present invention disclosed herein is to be included within the scope of the claims stated below.

What is claimed is:

1. An improved Christmas bulb structure, comprising:

a bulb shell;

two conductive wires extending from the interior of said bulb shell to the exterior of said bulb shell;

an insulator disposed within said bulb shell, separating said two conductive wires;

an elastic platelet protruding from said insulator between said two conductive wires;

a tungsten filament connecting said elastic platelet and one of said conductive wires; and a transverse conductive wire installed inside said insulator within said bulb shell and electrically coupling said two conductive wires, wherein when said bulb structure is electrically powered, the other conductive wire will be contacted by said elastic platelet and said tungsten filament will be energized, said elastic platelet bending to be spaced from the other conductive wire and de-energize said tungsten filament responsive to heating from said tungsten filament, whereby said transverse conductive wire enables said Christmas bulb structure to possess two current paths.

2. The improved Christmas bulb structure according to claim 1, wherein the material of said transverse conductive wire is the same as that of said two conductive wires.

3. The improved Christmas bulb structure according to claim 1 or claim 2, wherein the material of said transverse conductive wire or said two conductive wires is a magnesium-plated wire.

4. The improved Christmas bulb structure according to claim 1, wherein said bulb shell is made of a glass or a plastic material.

* * * * *